US006198076B1

(12) United States Patent
Moen et al.

(10) Patent No.: US 6,198,076 B1
(45) Date of Patent: Mar. 6, 2001

(54) CONVECTION OVEN

(75) Inventors: Vernon D. Moen, Eau Claire; Matthew J. DeWitte, Altoona; Lawrence J. Tienor, Eau Claire, all of WI (US)

(73) Assignee: National Presto Industries, Inc., Eau Claire, WI (US)

( * ) Notice: Subject to any disclaimer, the term of this patent is extended or adjusted under 35 U.S.C. 154(b) by 0 days.

(21) Appl. No.: 09/441,844

(22) Filed: Nov. 17, 1999

(51) Int. Cl.[7] ..... A21B 1/26
(52) U.S. Cl. ..... 219/400; 126/21 A; 99/476
(58) Field of Search ..... 219/400; 126/21 A; 99/474, 476; 34/197

(56) References Cited

U.S. PATENT DOCUMENTS

| | | | | |
|---|---|---|---|---|
| 3,807,383 | | 4/1974 | Lawler . | |
| 3,858,329 | | 1/1975 | Koide et al. . | |
| 4,152,842 | | 5/1979 | Laughlin . | |
| 4,238,669 | | 12/1980 | Huntley . | |
| 4,249,067 | | 2/1981 | Cummings . | |
| 4,317,025 | | 2/1982 | Starnes . | |
| 4,380,127 | | 4/1983 | Roberts . | |
| 4,484,063 | | 11/1984 | Whittenburg et al. . | |
| 4,503,760 | | 3/1985 | Pryputsch et al. . | |
| 4,536,643 | * | 8/1985 | Erickson | 219/400 |
| 4,584,467 | | 4/1986 | Ruiz . | |
| 4,591,698 | | 5/1986 | Chang . | |
| 4,687,908 | | 8/1987 | Thorne . | |
| 4,687,909 | | 8/1987 | Eichler et al. . | |
| 4,817,509 | | 4/1989 | Erickson . | |
| 4,924,763 | | 5/1990 | Bingham . | |
| 5,165,328 | | 11/1992 | Erickson et al. . | |
| 5,205,273 | | 4/1993 | Sparks et al. . | |
| 5,235,150 | | 8/1993 | Buske et al. . | |
| 5,269,072 | | 12/1993 | Waligorski . | |
| 5,276,309 | | 1/1994 | Hasse et al. . | |
| 5,379,527 | * | 1/1995 | Su | 219/400 |
| 5,420,393 | | 5/1995 | Dornbush et al. . | |
| 5,423,249 | | 6/1995 | Meyer . | |
| 5,458,050 | * | 10/1995 | Su | 219/400 |
| 5,466,912 | | 11/1995 | Dornbush et al. . | |
| 5,485,780 | | 1/1996 | Koether et al. . | |
| 5,520,096 | * | 5/1996 | Dornbush et al. | 99/476 |
| 5,533,444 | | 7/1996 | Parks . | |
| 5,601,070 | | 2/1997 | Hotard et al. . | |
| 5,620,623 | * | 4/1997 | Baker | 219/400 |
| 5,695,668 | | 12/1997 | Boddy . | |
| 5,749,288 | | 5/1998 | Skaling . | |
| 5,814,793 | | 9/1998 | Yu . | |
| 5,816,234 | | 10/1998 | Vasan . | |
| 5,950,526 | * | 9/1999 | Hsu | 99/476 |
| 5,996,480 | * | 12/1999 | Kelley et al. | 99/476 |

* cited by examiner

*Primary Examiner*—Joseph Pelham
(74) *Attorney, Agent, or Firm*—Merchant & Gould P.C.

(57) ABSTRACT

A non-recirculating convection oven includes an upper housing portion defining a food heating chamber. The upper housing portion includes a removable lid, to access the food heating chamber. At least one exhaust air outlet allows air to exhaust to an exterior of the upper housing portion. A food supporting tray is positioned in the food heating chamber, with the tray including a solid food supporting portion. A lower housing portion below the upper housing portion includes an intake air inlet for intake air, and a blower assembly for heating the intake air and delivering it to the food heating chamber wherein the intake air enters the lower housing portion at the intake air inlet, and the intake air is then heated to a temperature of at least 250° F. The heated air exits the food heating chamber at the at least one exhaust air outlet, wherein none of the heated air is recirculated within the oven to the blower assembly.

33 Claims, 19 Drawing Sheets

CONVECTION OVEN

FIELD OF THE INVENTION

The present invention relates generally to food heating devices, and more specifically to convection ovens.

BACKGROUND OF THE INVENTION

Various food heating devices are known, such as convection ovens utilizing recirculated air as part of the heating process. Air is recirculated from the food heating chamber back to a blower and a heating element for reheating and recirculation back to the food heating chamber. Various food items can be heated, warmed, or cooked in the oven. One problem with convection ovens of this type is that greater emphasis is needed for the parts associated with the blower (e.g., housing, fan and motor) since the air being handled by the blower is above room temperature.

Various other food heating devices are known, including dehydrators. Dehydrators are often used to dry meats and fruits. Typically, dehydrators utilize lower temperature air (e.g., about 150° F.) and are used over an extended period of time (e.g., several hours). Further, the food items are often consumed at a later time, rather than immediately after heating while in the heated condition.

There is a need for continued development of food heating devices, such as convection ovens, where cost issues are addressed, and sufficiently high temperature air is generated so as to heat food in a desired manner, such as to heat, warm, or cook appetizers or other foods to be consumed for meals or snacks.

SUMMARY OF THE INVENTION

One aspect of the present invention relates to non-recirculating convection ovens including a housing enclosing a food heating chamber where the housing includes a removable lid and at least one exhaust air outlet to the exterior of the food heating chamber. A food supporting tray is positioned in the food heating chamber. The food supporting tray has a solid food supporting portion. A blower assembly is provided for heating intake air and moving the heated air through the food heating chamber to cook one or more food items positioned on a tray. The heated air is exhausted from the food heating chamber at the at least one exhaust air outlet to the atmosphere after cooking the one or more food items supported on the tray. The intake air is taken entirely from the atmosphere around the convection oven and none of the exhaust air is reheated. Generally, the heated air is at least 250° F. adjacent to the food to be heated. The present invention also relates to a method of cooking food where the exhaust air is not recirculated.

Other aspects of the invention relate to non-recirculating convection ovens and other ovens which utilize heated, moving air where an upper housing portion defines a food heating chamber. The upper housing portion includes an outer wall portion, a removable lid, and at least one exhaust air outlet. A lower housing portion below the upper housing portion includes an intake air inlet for intake air, a motor, a fan driven by the motor, and a heating element. A heated air outlet from the lower housing portion is in air flow communication with the food heating chamber.

One aspect of the present invention includes using a single food supporting tray where the tray includes an aperture through a center portion of the tray, and where a food supporting portion of the tray surrounding the center portion is solid. The tray may further include an upwardly extending central lip. An air passage may be defined between the outer wall portion of the upper housing portion and an outer periphery of the tray. Heated air passes above and below the tray before exiting the oven. Instead of having a central opening, the tray may be completely solid. The at least one exhaust air outlet is positioned between the removable lid and the outer wall portion of the upper housing portion, or in the lid.

A further aspect of the present invention includes the use of a plurality of stacked food supporting trays in the food heating chamber where the trays include a solid food supporting portion, and at least one of the trays includes an aperture through a center portion of the tray, the food supporting portion of the tray with the aperture surrounding the center portion. Preferably, another of the trays lacks a central opening.

An additional aspect of the present invention includes a symmetrical housing and a symmetrical tray where the housing and the tray generally define circular or round outer peripheries. Still further aspects relate to various flow directing features within the upper housing portion provided for circulation of the heated air within the food heating chamber.

A further aspect of the present invention relates to the lower housing portion being separable from the upper housing portion. The lower housing portion may include a lip formed around the heated air outlet from the lower housing portion. The upper housing includes a heated air inlet opening sized for receipt of the lip of the lower housing portion.

DETAILED DESCRIPTION OF THE PREFERRED EMBODIMENTS

Figure 1:
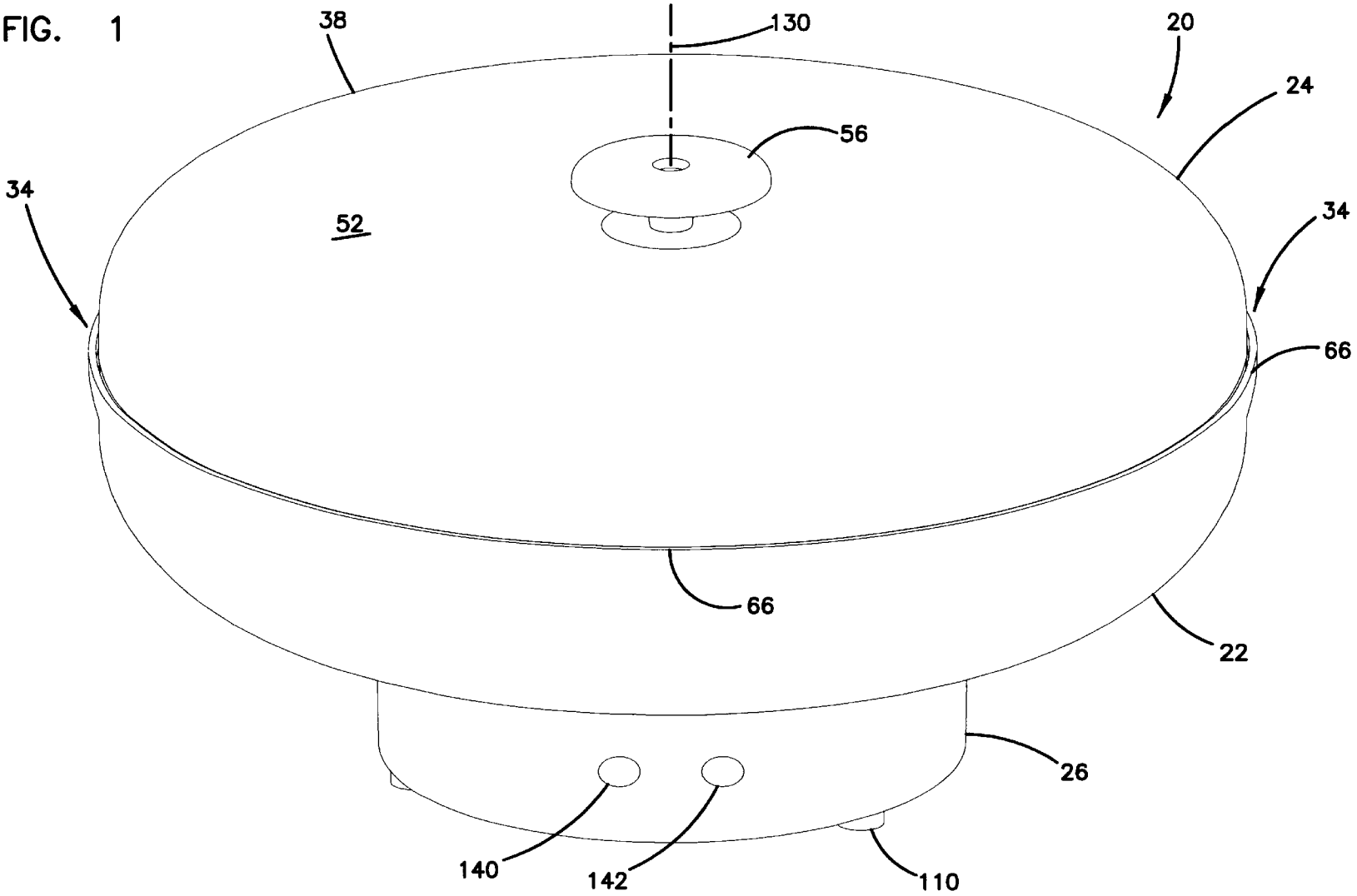
FIG. 1 is a perspective view of a first embodiment of a convection oven in accordance with the present invention.
Figure 2:
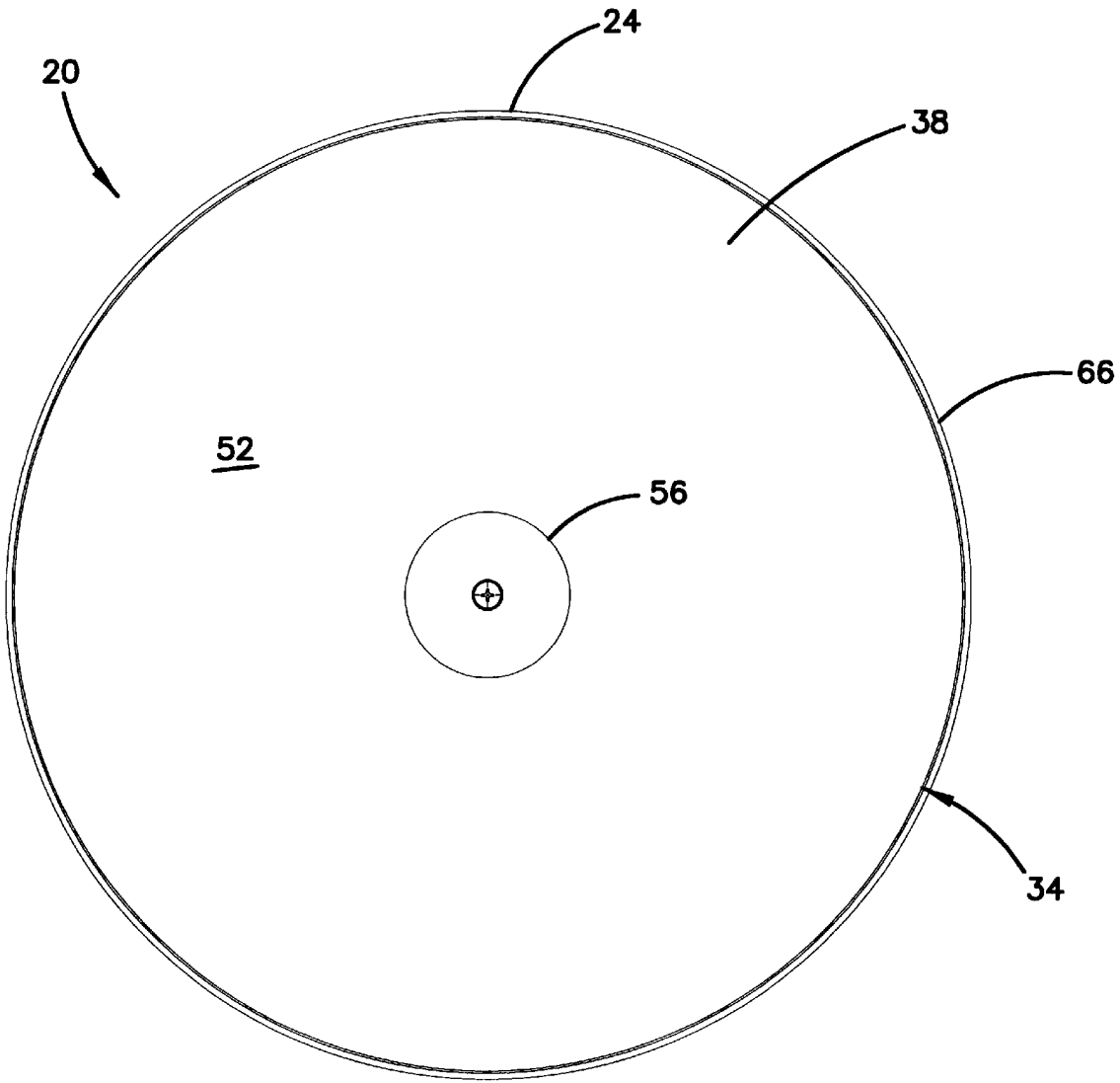
FIG. 2 is a top view of the convection oven of FIG. 1.
Figure 3:
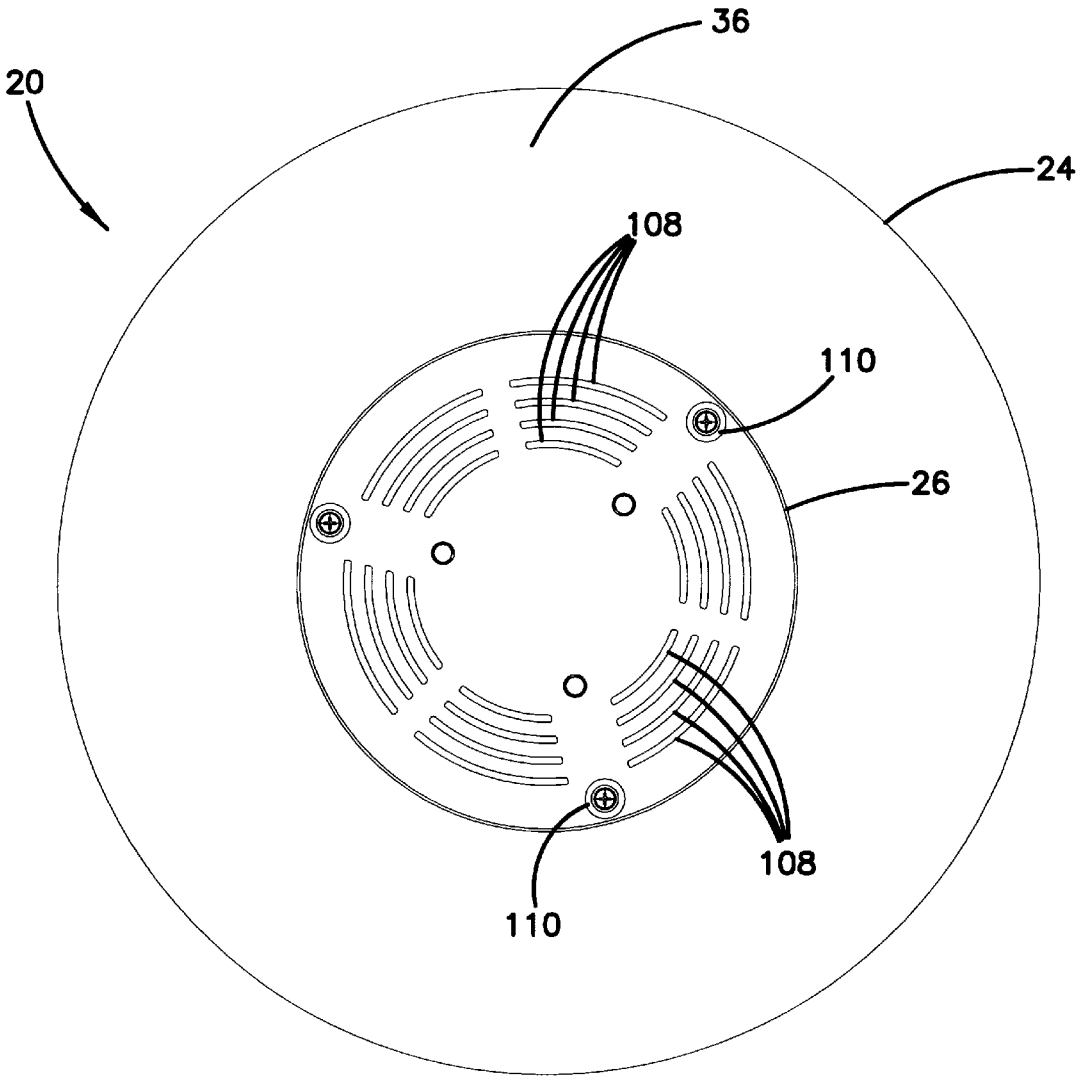
FIG. 3 is a bottom view of the convection oven of FIG. 1.
Figure 4:
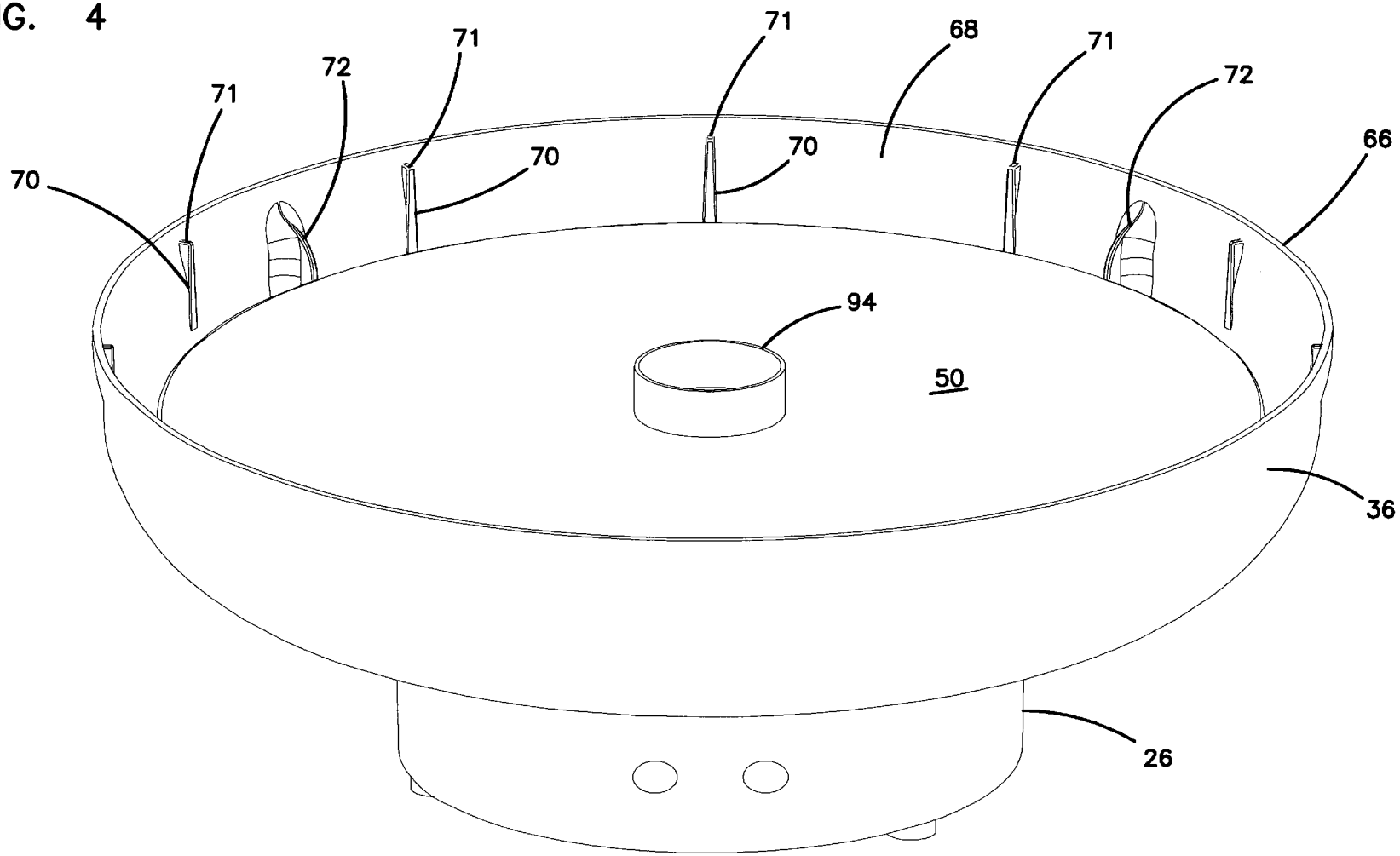
FIG. 4 is a perspective view of the convection oven of FIG. 1 without the lid.
Figure 5:
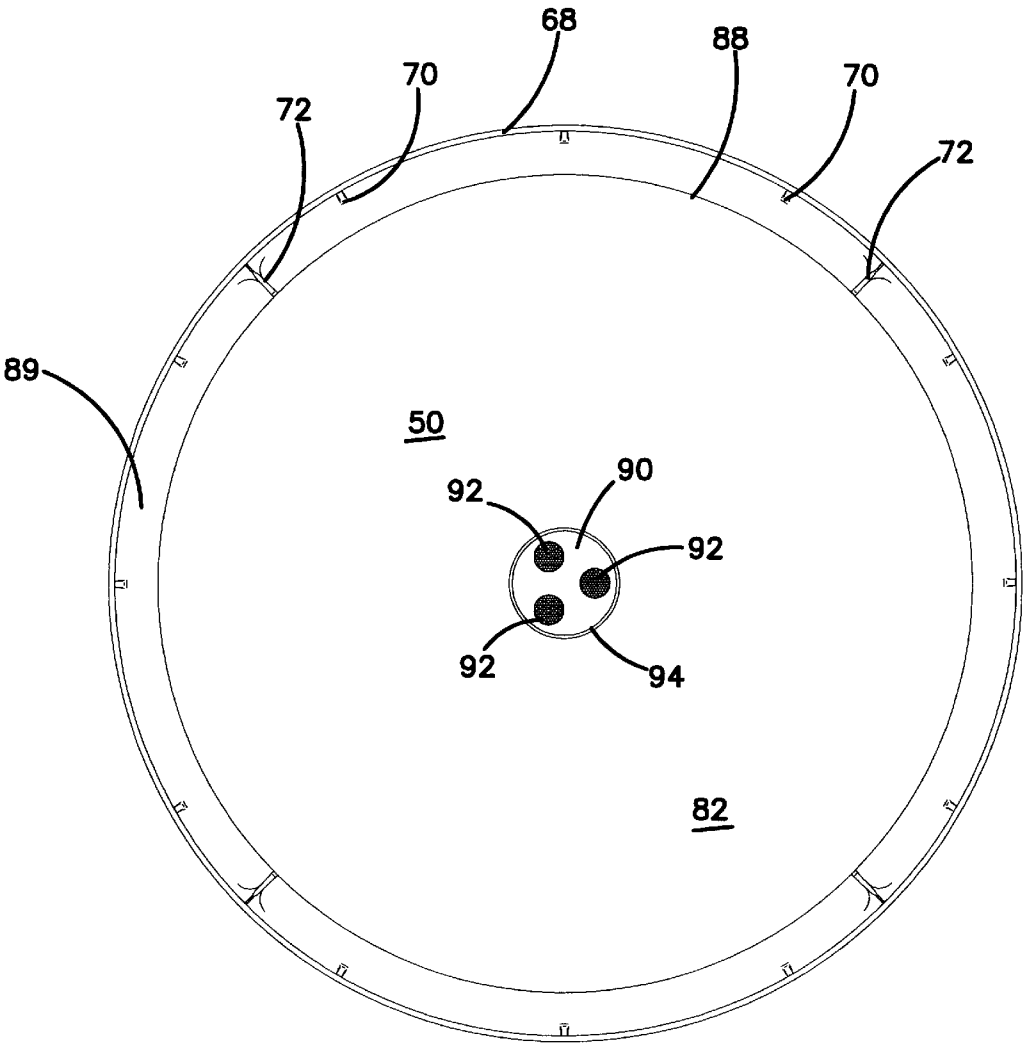
FIG. 5 is a top view of the convection oven of FIG. 4.
Figure 6:
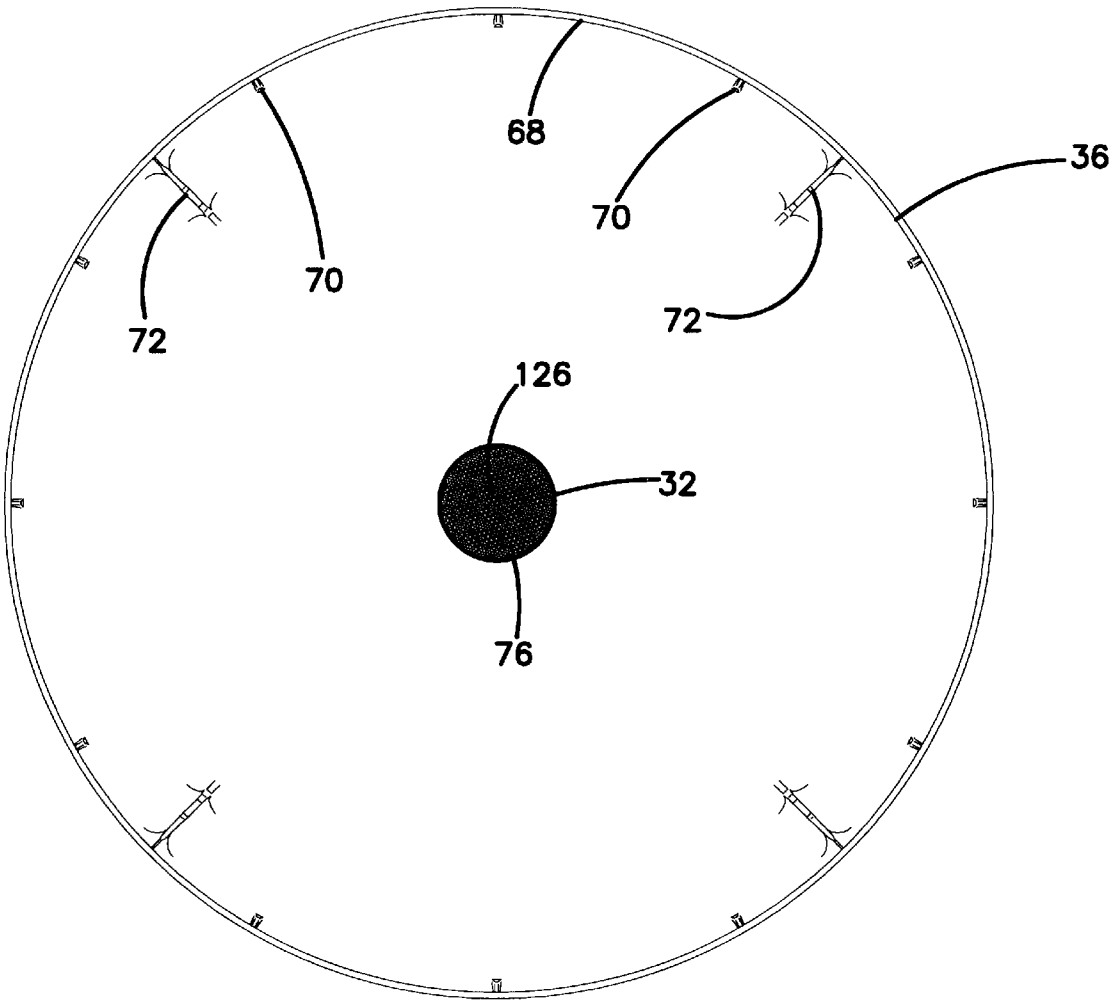
FIG. 6 is a top view of the convection oven of FIG. 4, with both the lid and the tray removed.

The present preferred embodiments concern non-recirculating convection ovens which preferably provide heated, moving air in a food heating chamber or area of the oven above at least 250° F. (about 121° C.). More preferably, the heated air is between 300° F. (about 149° C.) and 450° F. (about 232° C.) adjacent to the food heating area The heated air is used for heating, warming, or cooking of one or more food items in the food heating area to a desired condition. Heated air is preferably continuously supplied to the food heating area By use of the term "non-recirculating," it is meant that exhaust air from the food heating chamber or area is released to the atmosphere, and intake air to the heating element is drawn from the atmosphere, surrounding the oven. During heating, warming, or cooking of the food item(s), it is to be appreciated that the food item(s) may dehydrate or lose moisture, resulting in a drier or crispier food item, ready for consumption. However, the device of the present invention is more appropriately termed a "convection oven" due to the temperatures of the heated air, the length of time the food items are typically in the oven, and the manner in which the food items are served to consumers in the heated state. For example, a cooking time of about 5 to 15 minutes is anticipated for many of the food items to be heated in the oven at the above noted temperatures. Various foods can be heated, warmed or cooked with the oven including appetizers, breads, cookies, and other foods to be consumed for meals or snacks.

Referring now to FIGS. 1–9, a first preferred embodiment of a convection oven 20 is shown. Oven 20 includes a housing 22 having an upper portion 24 and a lower portion 26. Upper portion 24 includes a food heating chamber 30 (see FIG. 7). A heated air inlet 32 receives heated air from lower portion 26. An exhaust air outlet 34 exhausts air from the food heating chamber 30 to the atmosphere. Contained within lower portion 26 of housing 22 is a blower assembly 40 for heating air to a desired temperature for use in heating, warming, or cooking food contained within food heating chamber 30 during use of oven 20. Lower portion 26 includes an intake air inlet 42 for drawing air from the atmosphere around oven 20 into blower assembly 40. Lower portion 26 further includes a heated air outlet 44 which communicates with heated air inlet 32 of upper portion 24. Also contained within food heating chamber 30 is a tray 50 for supporting one or more food items within food heating chamber 30 during use of oven 20.

Upper portion 24 of housing 22 includes an outer wall portion 36 defining a lower part, and are movable lid 38 defining an upper part. Lid 38 includes a wall portion 52 having an inside surface 54 and a handle 56 on an exterior of wall portion 52. A peripheral edge 58 mates with outer wall portion 36. Inside surface 54 includes a central, downwardly facing apex 60 and a curved annular portion 62. The apex 60 and the curved annular portion 62 help direct airflow through oven 20 so as to sufficiently heat, warm, or cook the food.

Outer wall portion 36 includes a peripheral edge 66 generally aligned with peripheral edge 58 of lid 38. At the interface, a small annular gap between edges 58, 66 forms exhaust air outlet 34 to allow for heated air to exhaust to the atmosphere. An inside surface 68 of outer wall portion includes a plurality of projecting first ribs 70 for supporting lid 38. First ribs 70 include a lip 71 for engaging peripheral edge 58 of lid 38. A plurality of projecting second ribs 72 support tray 50. Second ribs 72 include a lip 73 for engaging an edge of tray 50. Tray 50 drops into outer wall portion 36, and rests on second ribs 72. Outer wall portion 36 further includes a central upwardly facing apex 74 defining a central opening 76 which forms heated air inlet 32. Outer wall portion 36 further includes a curved annular region 78. Grease, other food drippings, and crumbs can collect at trough region 79, for later removal. Annular region 78 also helps direct air flow.

Tray 50 includes a planar portion 82 defining a food supporting portion having a continuous surface. Planar portion 82 includes a top 84 and an opposite facing bottom 86. Planar portion 82 includes an edge 88. Edge 88 is spaced from inside surface 68 of outer wall portion 36 to define an airflow passage 89. At a center portion 90, one or more apertures 92 are provided for permitting air flow communication between top 84 and bottom 86. Around apertures 92, an annular lip 94 is provided.

Lower portion 26 of housing 22 includes an upper section 98, and a lower section 100 which cooperate to define a chamber 102 for receiving blower assembly 40. Upper and lower sections 98, 100 are held together with fasteners 104. Upper section 98 includes an opening 106 for receiving an upper portion of blower assembly 40. Lower section 100 includes one or more apertures 108 which form intake air inlet 42. Lower section 100 includes a plurality of feet 110 to support oven 20 above a countertop to allow airflow into oven 20.

Figure 7:
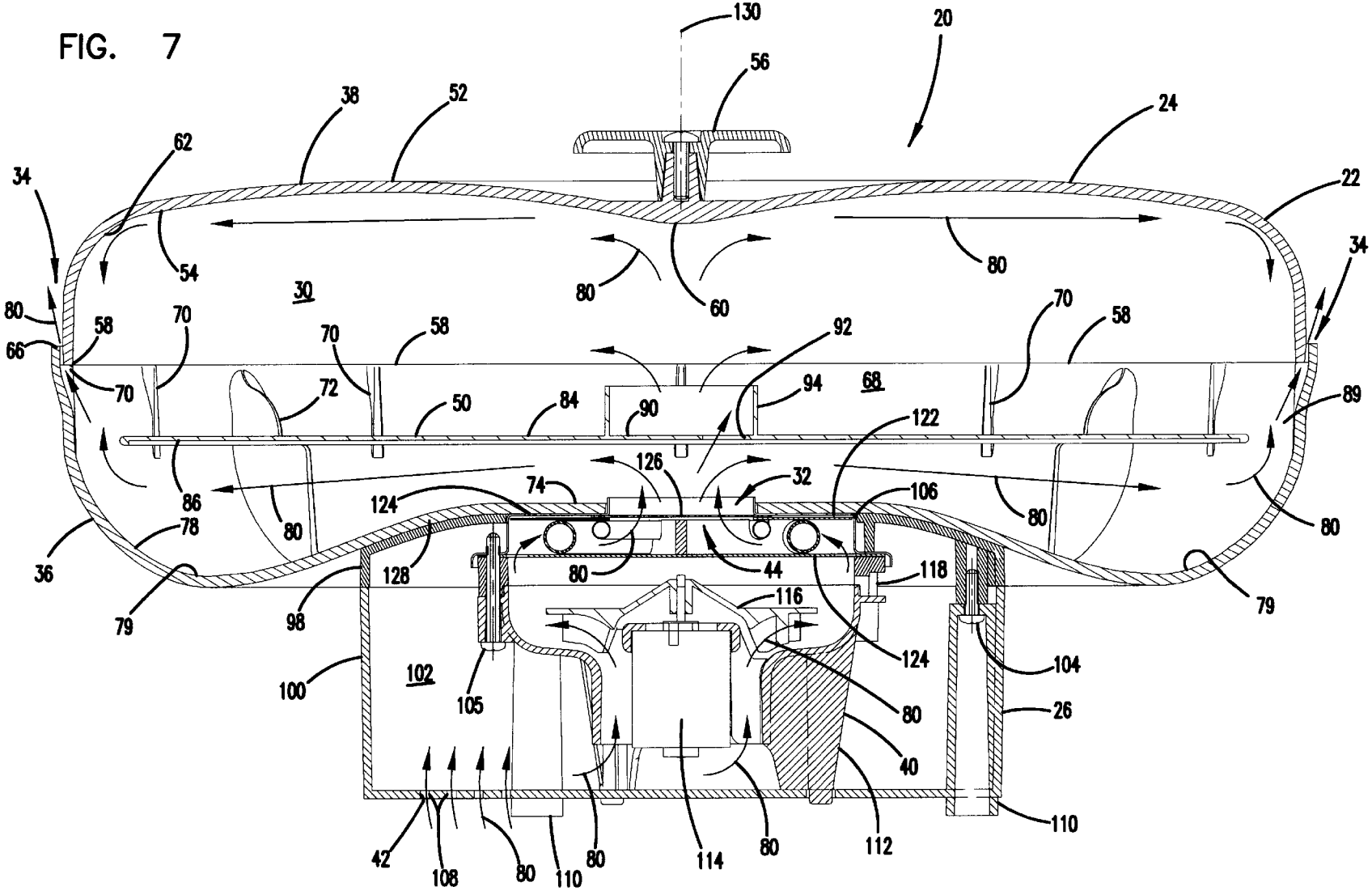
FIG. 7 is a cross-sectional side view of the convection oven of FIG. 1.

Blower assembly 40 is positioned between upper and lower sections 98, 100, as shown in FIG. 7. Blower assembly includes a motor mount 112 holding a motor 114 and a fan 116 driven by motor 114. Blower assembly 40 further includes a heat insulative spacer ring 118, a heater ring 120, a spacer disk 122, and a cover 124. A screen 126 prevents access to heater ring 120 by an operator. Screen 126 also prevents crumbs from falling into blower assembly 40. Heater ring 120 can be any of a variety of heating elements for heating of the air, and may be other shapes besides annular. Cover 124 defines an upwardly extending lip 125 which extends into upper portion 24 of housing 22. Cover 124 is joined to motor mount 112 with fasteners 105.

During use, intake air enters intake air inlet 42 and is driven by fan 116 past heater ring 120 which heats the air to the desired temperature. The heated air passes into food heating chamber 30 for heating of the food. The air is exhausted through exhaust air outlet 34 formed as an annular gap around the periphery of oven 20 between peripheral edge 58 of lid 38 and peripheral edge 66 of outer wall portion 36. Arrows 80 show airflow pathways through oven 20, illustrating the non-recirculating treatment of the heated air. By passing the heated air above and below tray 50 for the desired time, the food items on tray 50 become heated, warmed, or cooked.

Blower assembly 40 can take forms other than the embodiment illustrated, for providing heated, moving air to food heating chamber 30 of oven 20. For example, blower assembly 40 can be arranged so that the passage from blower assembly 40 to food heating chamber 30 is annular, instead of central. In that instance the heating element is positioned generally radially outside of the fan, and the outlet to the food heating chamber is generally radially outside of that.

For oven 20, a central axis 130 is shown. Preferably a number of features of oven 20 are symmetrical about axis 130, as shown in the FIGS. While not required, the preferred design includes a circular periphery.

Oven 20 also includes an on-off switch 140 and a timer 142 or other control system as desired. A temperature control including a temperature sensor may be added to control the temperature of the heated air in the food heating chamber. Control may be through a rheostat or a thermostat. The temperature can also be manually adjusted, even to temperatures below 250° F., if desired.

Figure 8:
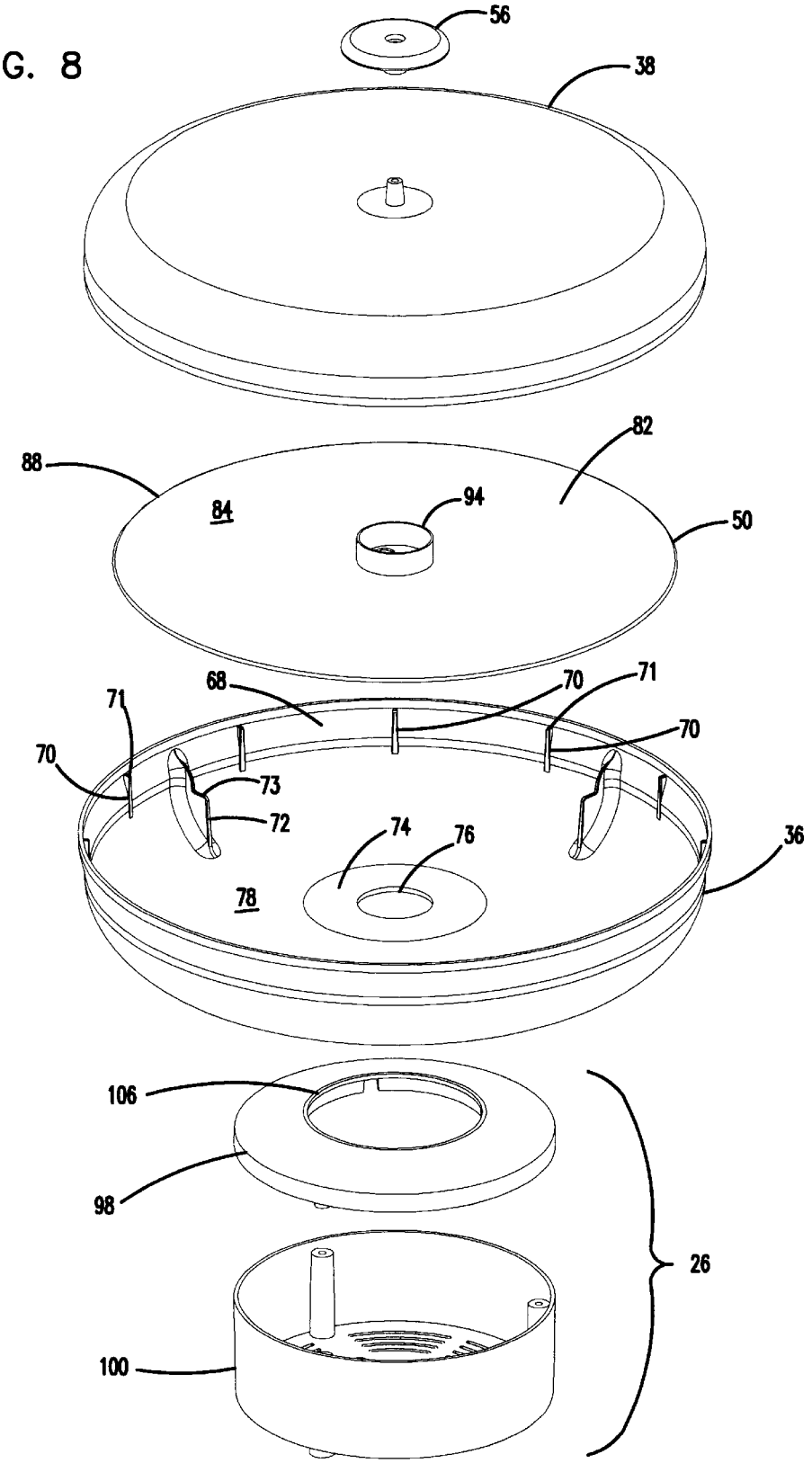
FIG. 8 is an exploded view of the housings and tray of the convection oven of FIG. 1.
Figure 9:
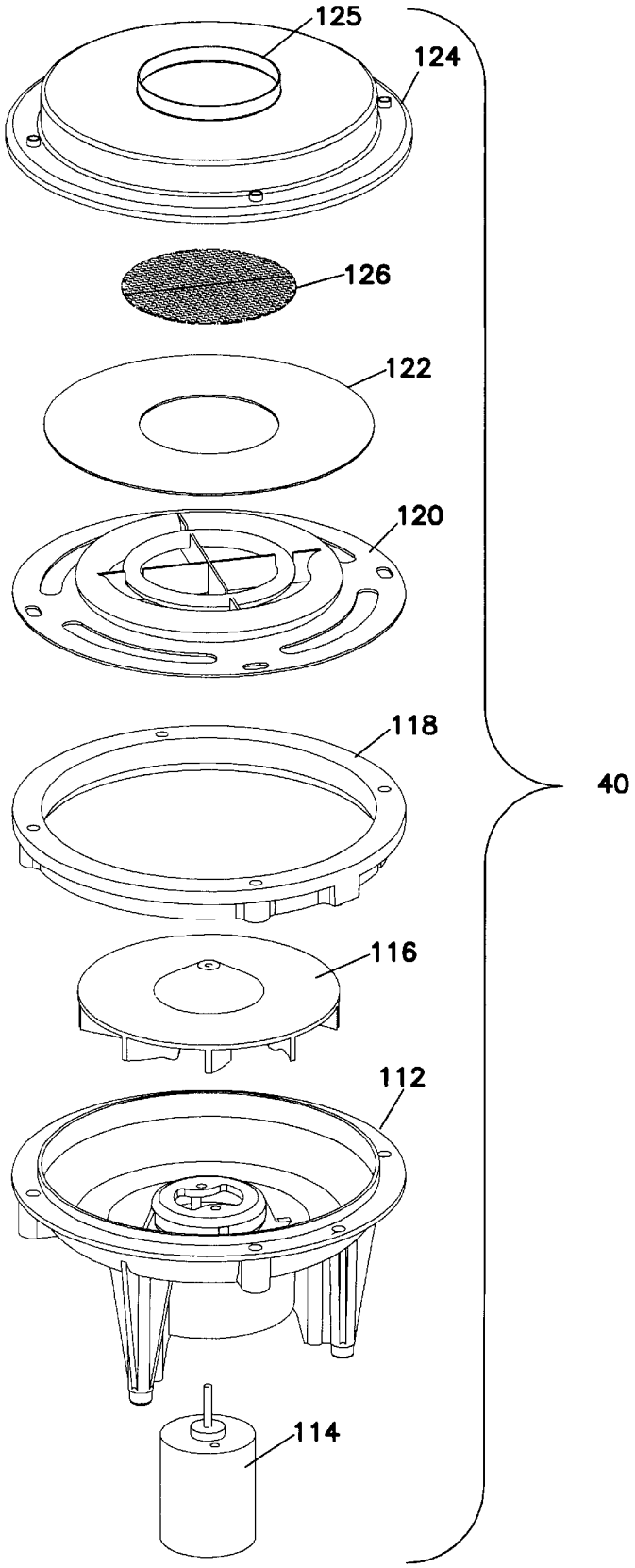
FIG. 9 is a further exploded view of the convection oven of FIG. 1 showing the blower assembly.

Tray 50 may be made from aluminum or other suitable material. As shown in FIG. 8, upper portion 24 separates from lower portion 26, such as to facilitate ease of cleaning, and storage. Upper portion 24 conveniently drops onto lip 125 of lower portion 26 to reassemble oven 20. Further, upper portion 24 has a concave shape, and lower portion 26 has a convex shape which nest together at interface 128.

Because various parts of oven 20 are not exposed to the high temperature airflow, these parts may be made from less expensive components and/or materials. For example, fan 116, motor mount 112, and lower section 100 of lower portion 26 may be advantageously made of low temperature, molded plastic, since these parts are not exposed to the high temperature airflow. Motor 114 can be a standard, low-voltage DC that does not need any special protective housing since only non-recirculated, room temperature, intake air passes nearby the motor during use.

Figure 10:
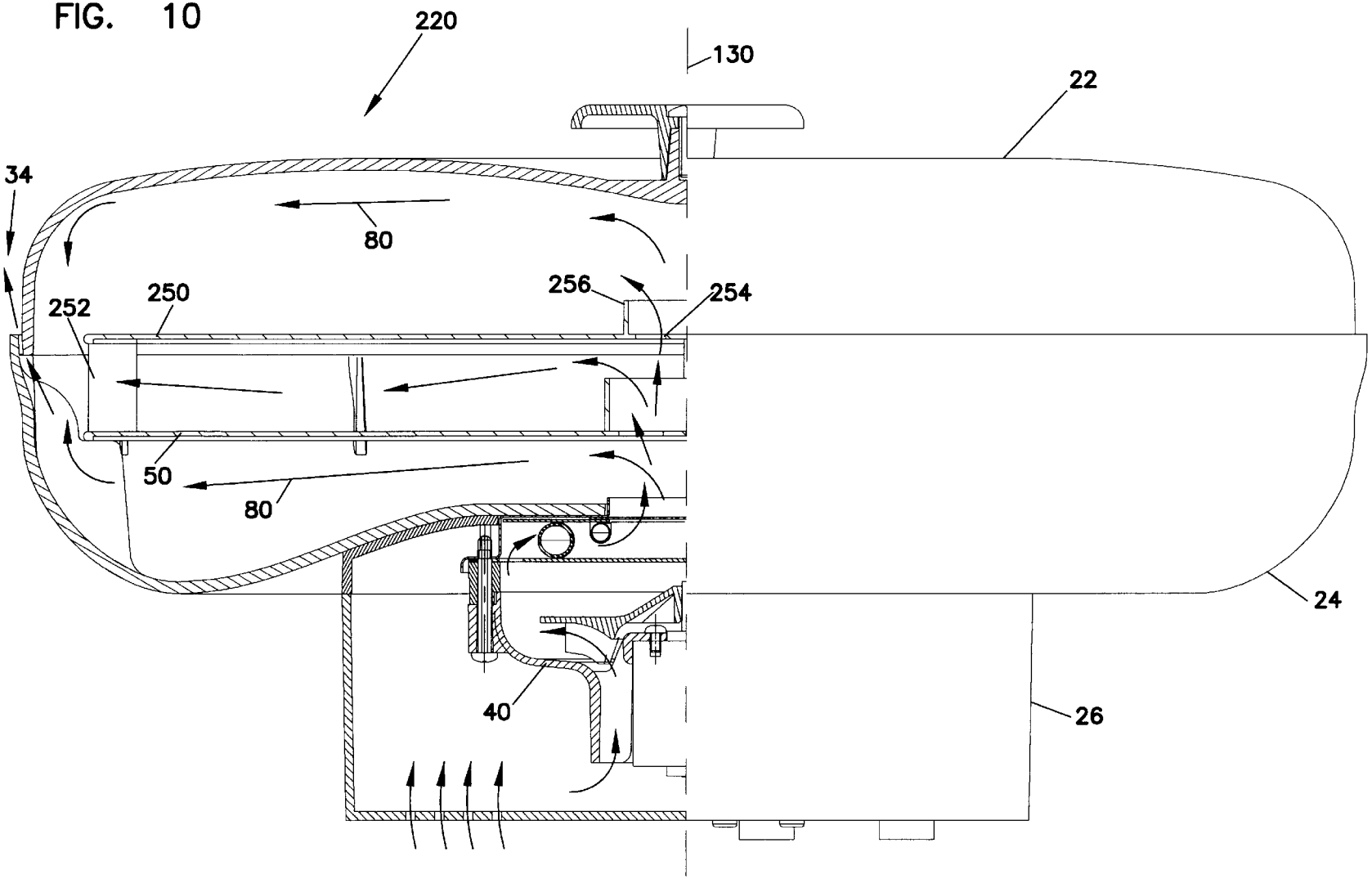
FIG. 10 is a partial cross-sectional side view of an alternative embodiment for the convection oven of FIG. 1, showing two trays.
Figure 11:
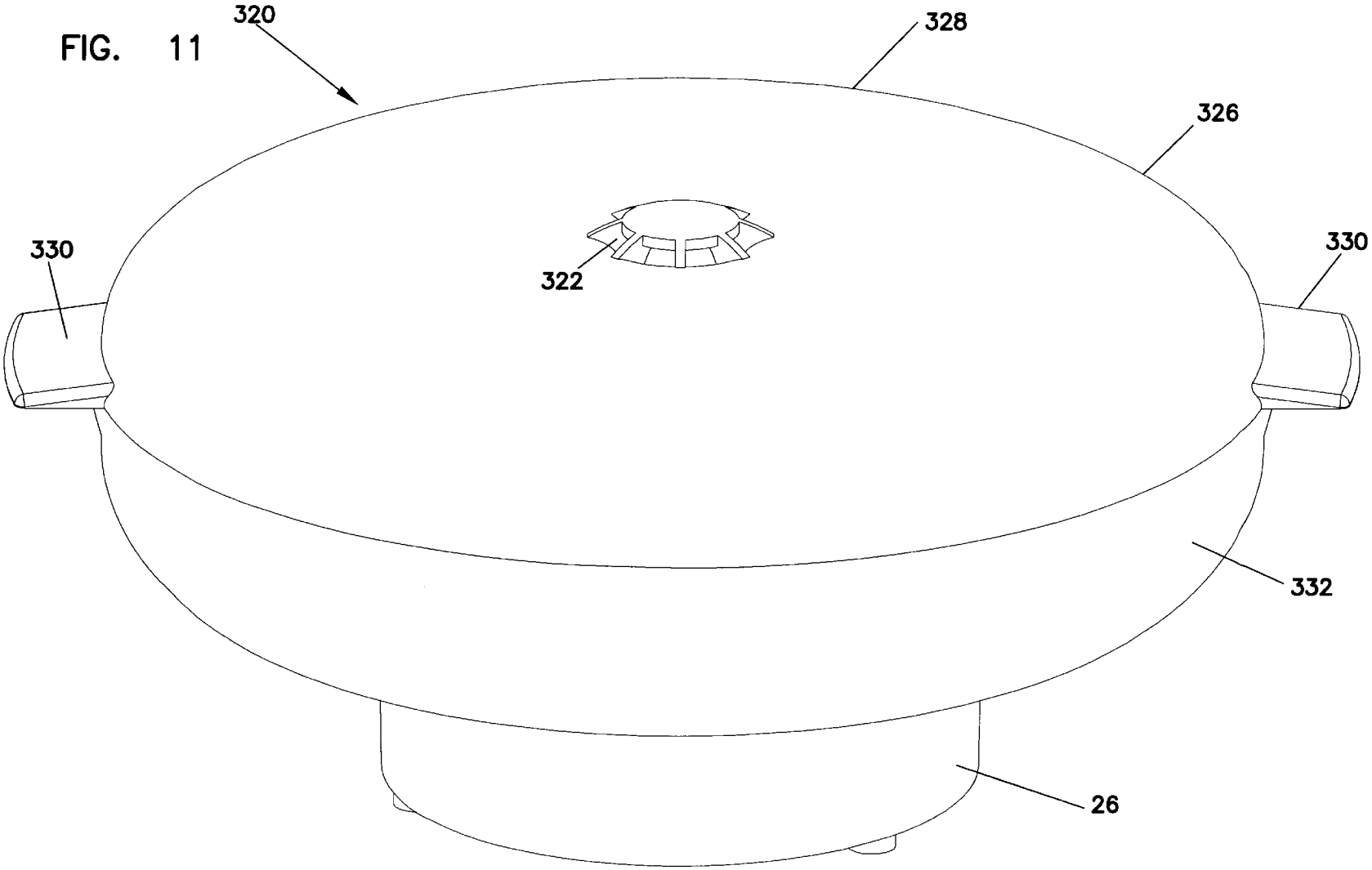
FIG. 11 is a further alternative embodiment of a convection oven to the embodiment of FIG. 1, and including a central exhaust air outlet through the lid.
Figure 12:
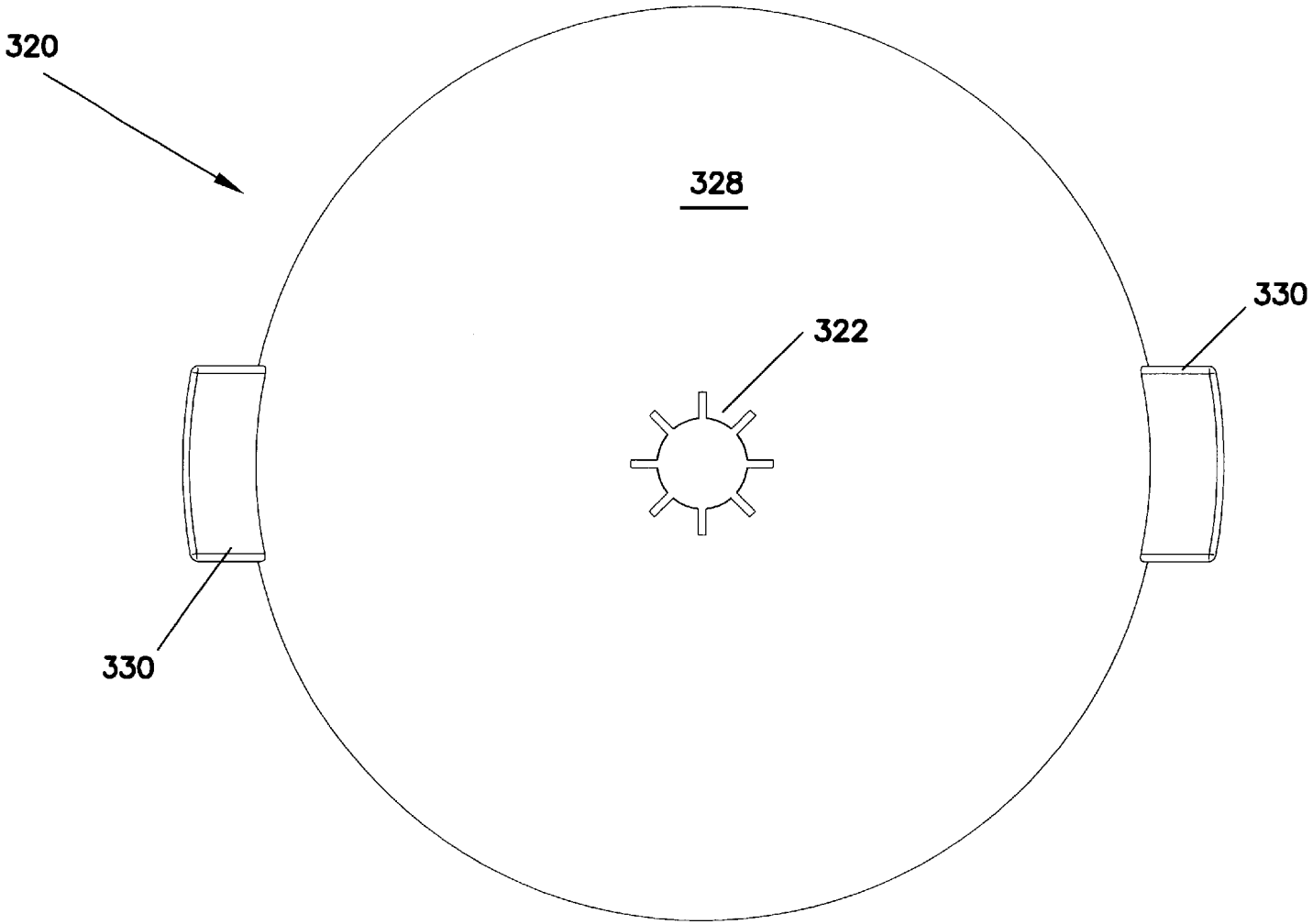
FIG. 12 is a top view of the convection oven of FIG. 11.
Figure 13:
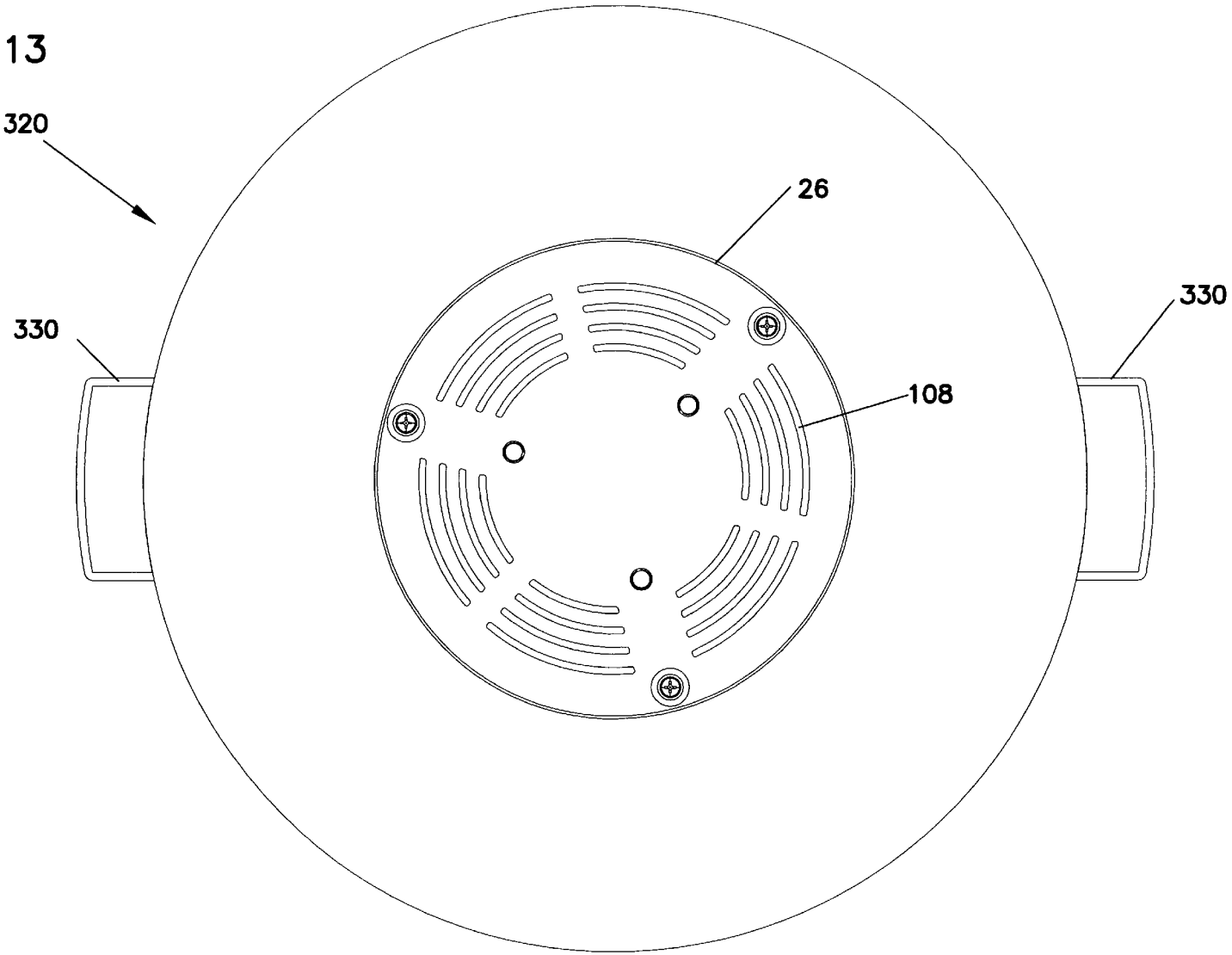
FIG. 13 is a bottom view of the convection oven of FIG. 11.
Figure 14:
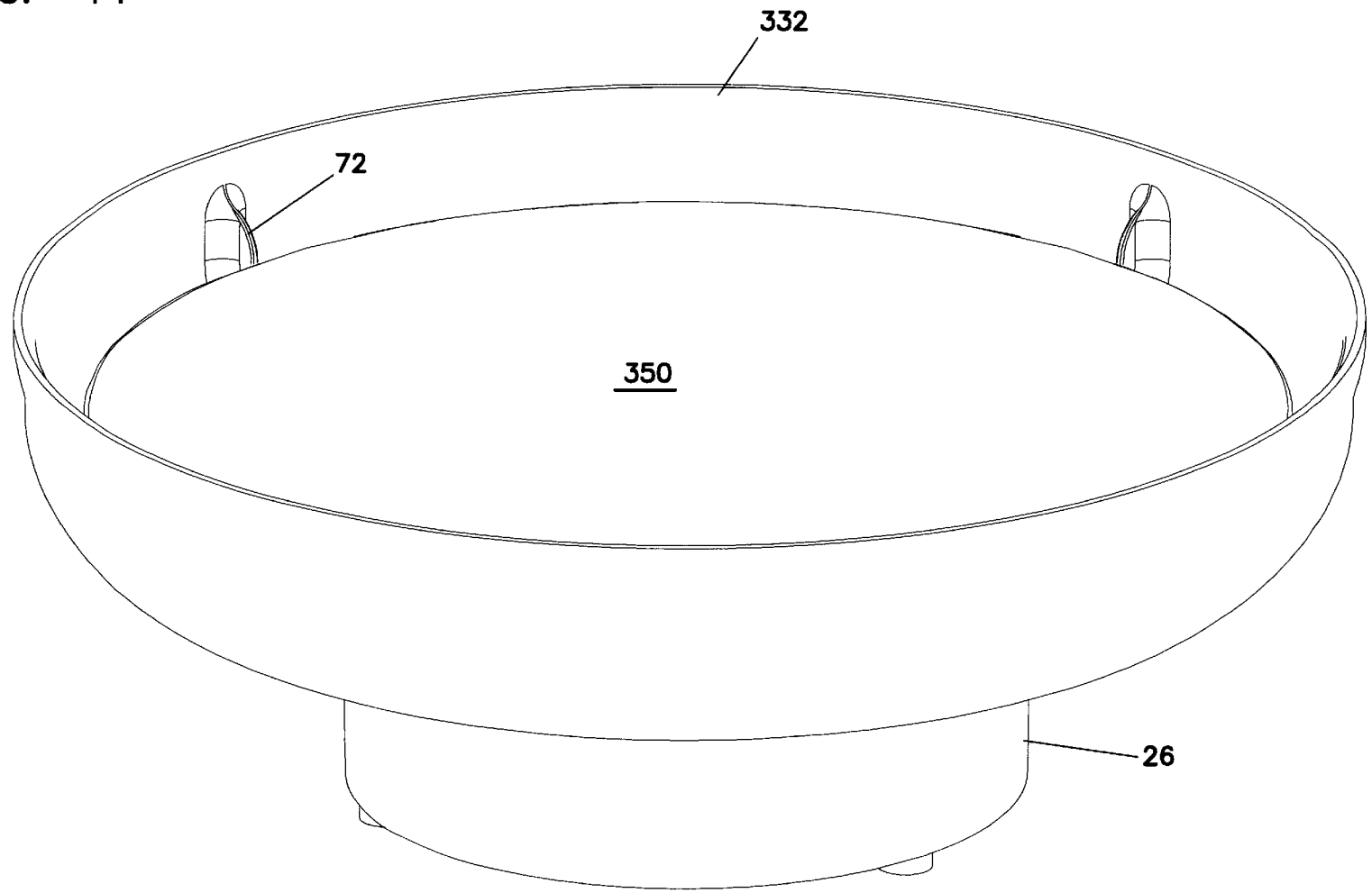
FIG. 14 is a perspective view of the convection oven of FIG. 11, without the lid.
Figure 15:
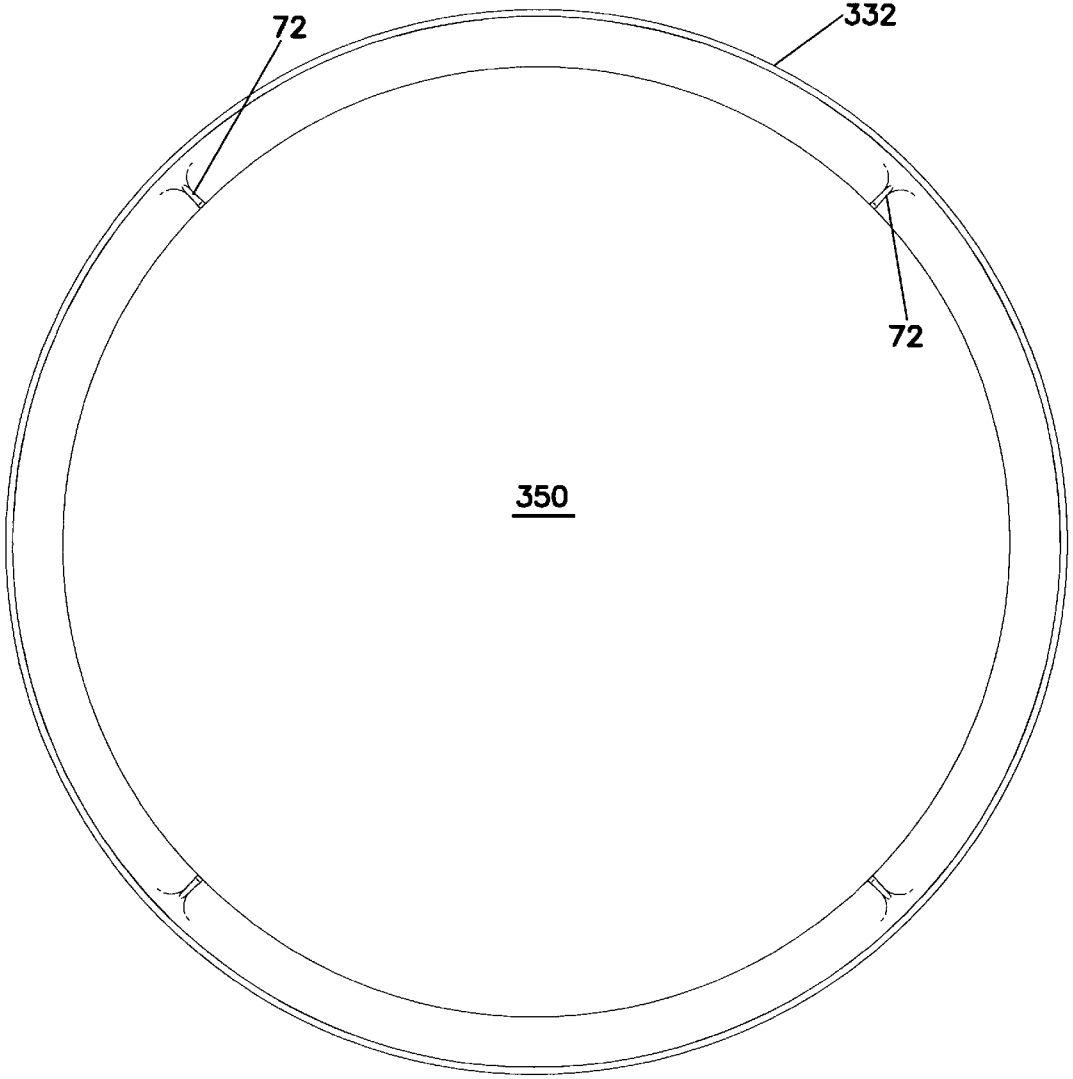
FIG. 15 is a top view of the convection oven of FIG. 14.
Figure 16:
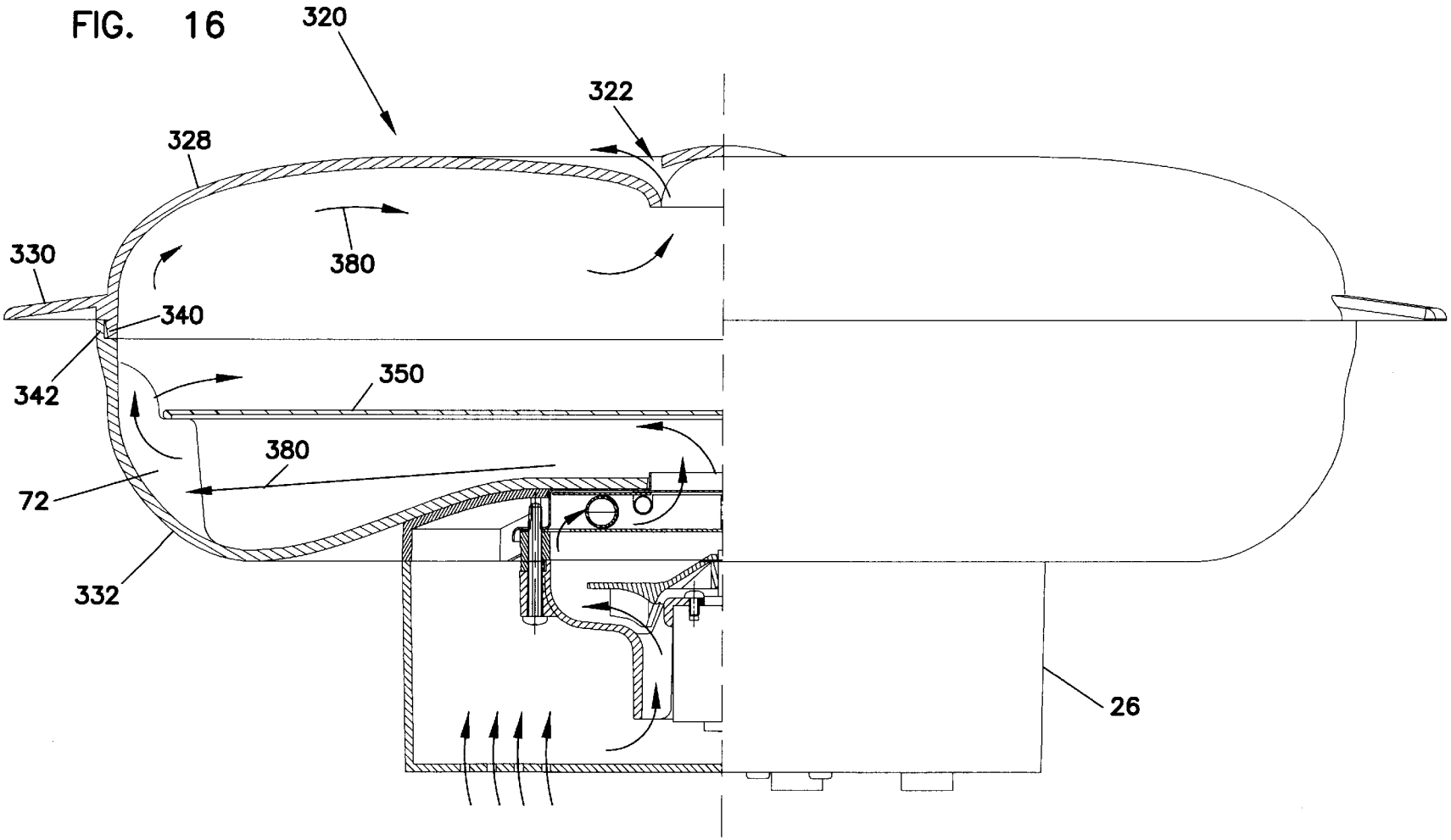
FIG. 16 is a partial cross-sectional side view of the convection oven of FIG. 11.

Referring now to FIG. 10, an alternative embodiment of a non-recirculating convection oven 220 is shown including a second tray 250 mounted above tray 50. Tray 250 includes spacers 252 for spacing tray 250 from tray 50. Upper tray 250 includes one or more central apertures 254, and a central lip 256 in a similar manner as tray 50. However, the central apertures of the two trays are not identically sized or exactly vertically aligned, so as to assist with desired airflow through the oven.

Referring now to FIGS. 11–16, an alternative embodiment of a non-recirculating convection oven 320 is shown where air is exhausted through an exhaust air outlet 322 positioned at a central portion of lid 328, instead of at the periphery of the lid. Outlet 322 is shown as including a plurality of openings molded or otherwise formed in lid 328. Further, a tray 350 is not provided with any central apertures or central annular lip. Lid 328 and an outer wall portion 332 form upper housing 326. Another difference over lid 38 is the provision of handles 330. Outer wall portion 332 is different over outer wall portion 36 in that ribs 70 are not needed for supporting the lid so as to define a gap for exhaust air. Instead, both peripheral edge 340 of lid 328, and peripheral edge 342 of outer wall portion 332 are stepped. Airflow arrows 380 show the airflow path through oven 320.

Figure 17:
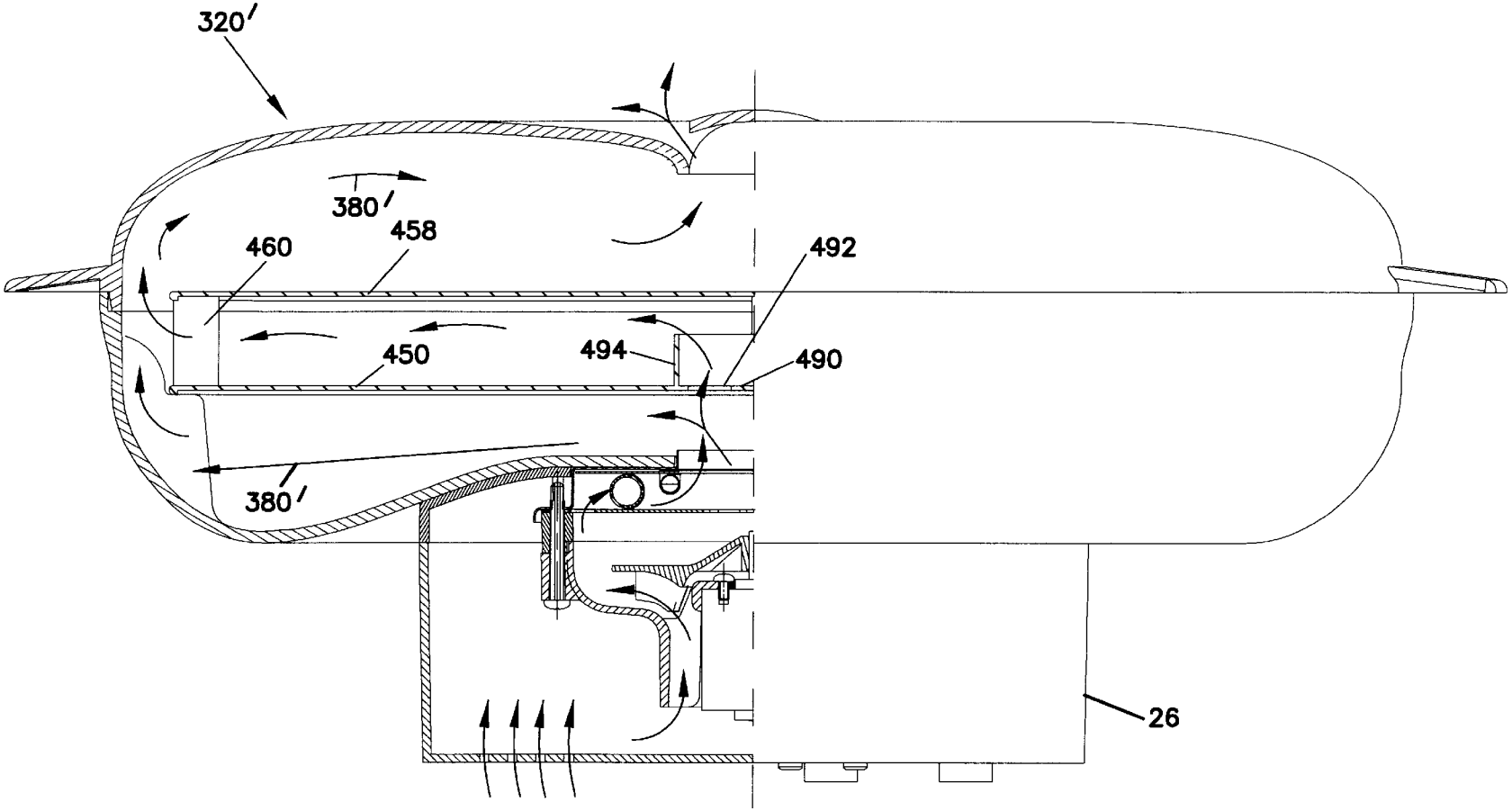
FIG. 17 is a partial cross-sectional side view of a further alternative embodiment for the convection oven of FIG. 11.
Figure 18:
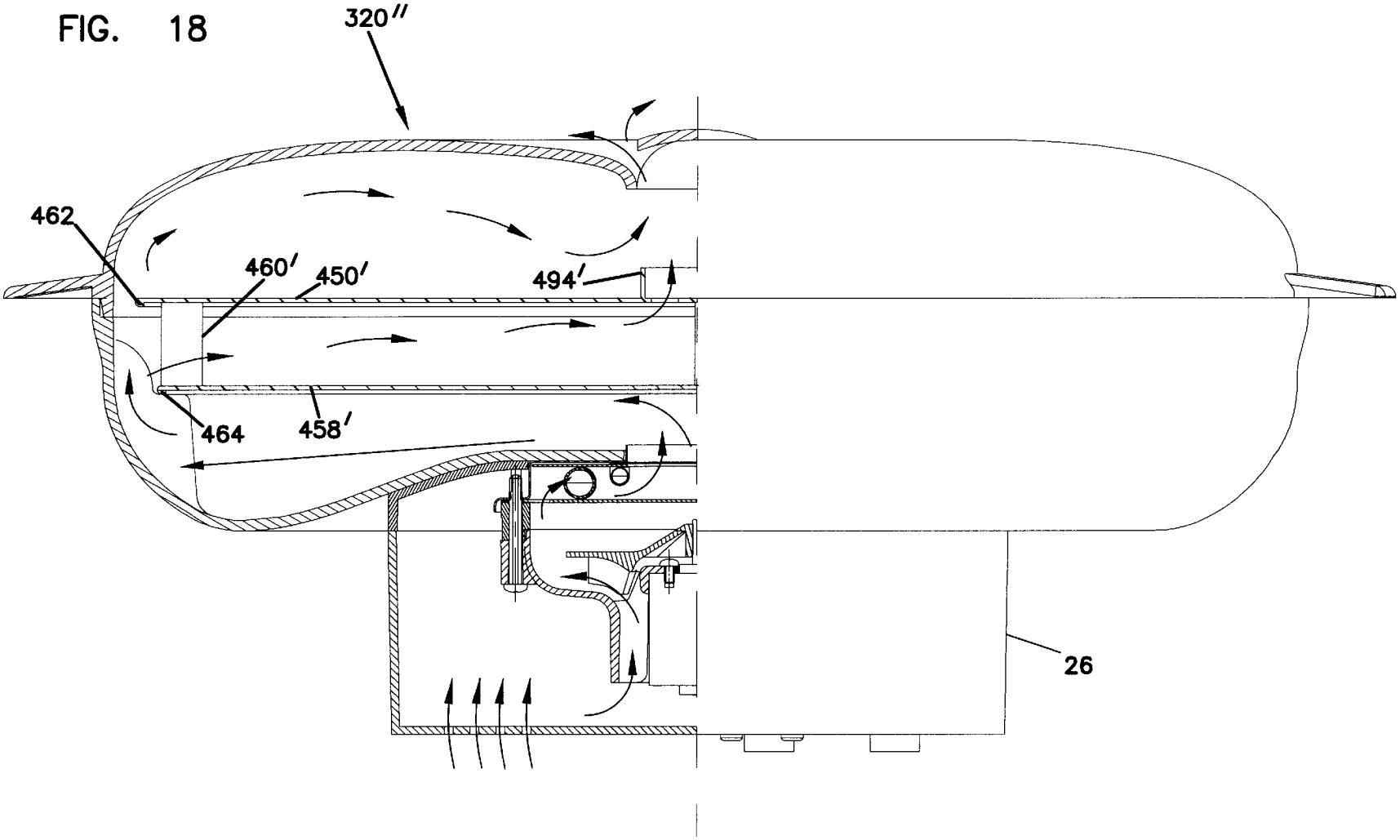
FIG. 18 is a partial cross-sectional side view of still further embodiment of a convection oven like the convection oven of FIG. 11.

FIGS. 17 and 18 show further embodiments of non-recirculating convection ovens 320', 320", including a second tray. In FIG. 17, a bottom tray 450 includes one or more apertures 492 through a central portion 490, as well as a central lip 494, like oven 20. A top tray 458 is a solid tray like tray 350 of FIGS. 11–16. Top tray is provided with spacers 460, as noted above in FIG. 10 for tray 250. In FIG. 18, the positions of trays 450' and 458' are reversed, and tray 450' includes spacers 460'. Lip 494' is smaller like lip 256 of tray 250 in FIG. 10. Also, edge 462 of tray 450' extends further from the axis than edge 464 of lower tray 458' to facilitate airflow between trays 450' and 458'. Airflow arrows 380', 380" show the airflow paths through ovens 320', 320".

Figure 19:
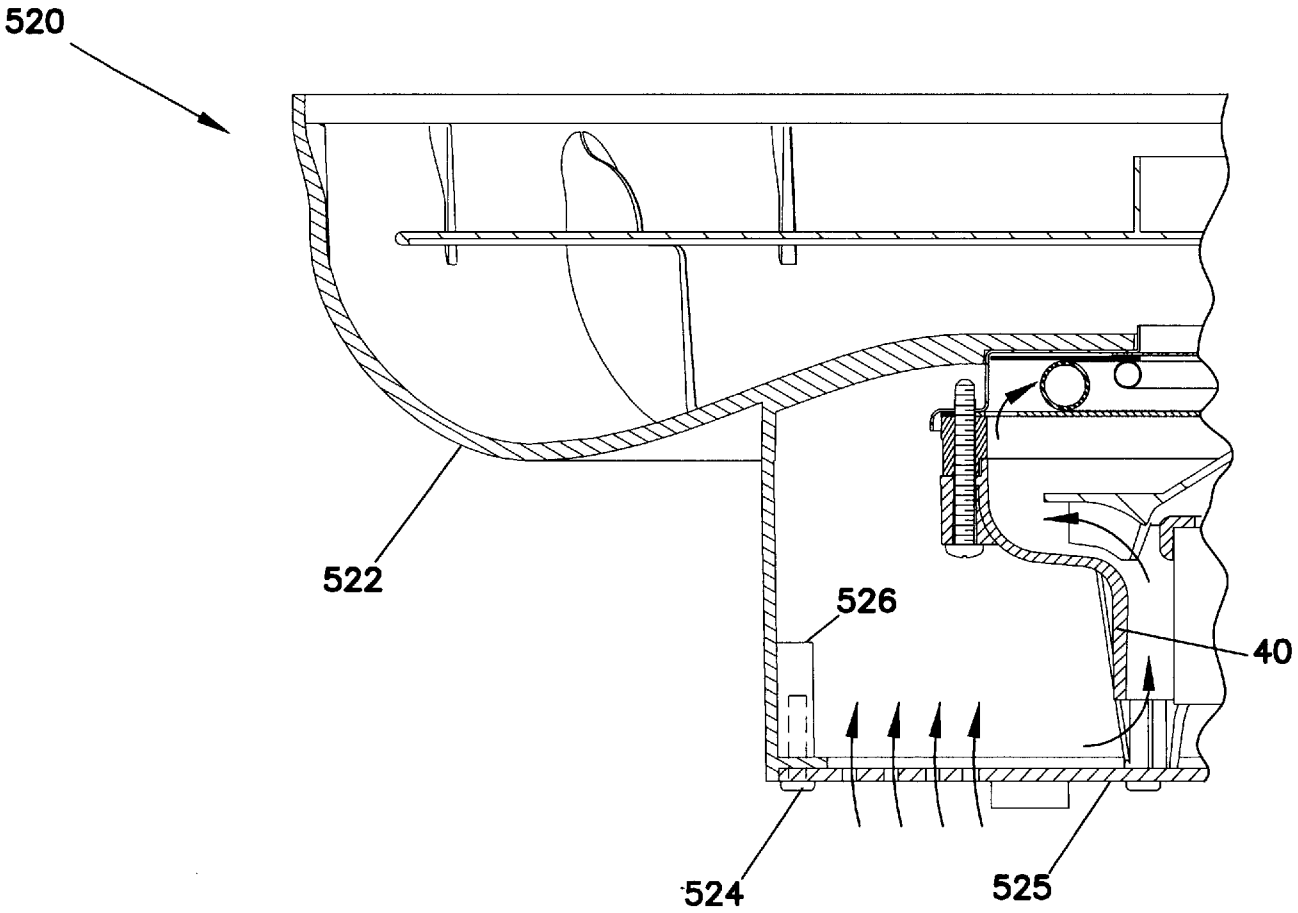
FIG. 19 is a cross-sectional side view of a portion of a further embodiment of a convection oven with a different housing structure to the embodiments of FIGS. 1–18.

Referring now to FIG. 19, an alternative embodiment of a non-recirculating convection oven 520 is shown including a non-separable housing 522 which is usable with a lid like lid 38 noted above. Housing 522 forms the lower portion of the food heating chamber, and it also encloses blower assembly 40. A separate lower base plate 525 holds blower assembly 40 within a lower portion of housing 522. Fasteners 524 secure base plate 524 each by engagement with a boss 526 of housing 522.

While the illustrated embodiments are non-recirculating convection ovens, various features of the present invention have applicability to other ovens, including ovens which may partially recirculate the heated air. One advantage for recirculating the heated air includes that the return air passage may be provided with a temperature sensor for use in temperature control of the oven. Another advantage in recirculating at least a portion of the air is that the blower assembly may be more efficient since some of the air at the intake to the heating element is above room temperature (pre-heated). Structural features such as the housing shapes, the tray shapes, and the separability of the housing portions are at least some aspects which may find applicability in other ovens besides the non-recirculating convection ovens of the preferred embodiments.

It is to be understood, that even though numerous characteristics and advantages of the invention have been set forth in the foregoing description, together with details of the structure and function of the invention, the disclosure is illustrative only, and changes may be made in detail, especially in matters as such shape, size, and arrangement of the parts within the principles of the invention to the full extent indicated by the broad general meaning of the terms which the appended claims are expressed.

What is claimed is:

1. A non-recirculating convection oven comprising:

(a) an upper housing portion defining a food heating chamber, the upper housing portion including:
  (1) an outer wall portion;
  (2) a removable lid, engageable with the outer wall portion to form the food heating chamber;
  (3) at least one exhaust air outlet to an exterior of the upper housing portion;
  (4) a single food supporting tray in the food heating chamber, the tray including an aperture through a center portion of the tray, a food supporting portion of the tray surrounding the center portion, the food supporting portion being solid;

(b) a lower housing portion below the upper housing portion including:
  (1) an intake air inlet for intake air;
  (2) a motor;
  (3) a fan driven by the motor for moving the intake air from the air intake inlet to a heating element;
  (4) a heating element, the motor, the fan, and the heating element housed within the lower housing portion;
  (5) a heated air outlet in air flow communication with the food heating chamber; wherein the intake air enters the lower housing portion at the intake air inlet, and the intake air is then heated by the heating element, wherein the heated air passes through the heated air outlet of the lower housing portion into the food heating chamber, wherein a first portion of the heated air is directed below the food supporting portion of the tray, and wherein a second portion of the heated air is directed through the aperture of the tray to an area above the food supporting portion of the tray, wherein the heated air exits the food heating chamber at the at least one exhaust air outlet, whereby the heated air is not recirculated within the oven to the fan.

2. The convection oven of claim 1, further comprising an upwardly extending lip around the center portion of the tray.

3. The convection oven of claim 1, further comprising an air passage between the outer wall portion of the upper housing portion and an outer periphery of the tray.

4. The convection oven of claim 1, wherein the at least one exhaust air outlet is positioned between the removable lid and the outer wall portion of the upper housing portion.

5. The convection oven of claim 1, wherein the lower housing portion includes a lip formed around the heated air outlet, wherein the upper housing portion is separable from the lower housing portion, and wherein the upper housing portion includes a heated air inlet opening sized for receipt of the lip of the lower housing portion.

6. The convection oven of claim 5, wherein the lower housing portion includes an upper section defining a convex shape, and wherein the upper housing portion includes a lower section defining a concave shape, the upper and lower sections of the lower and upper housing portions matable when the heated air inlet receives the lip of the lower housing portion.

7. The convection oven of claim 1, wherein the outer wall portion is generally symmetrical about a central longitudinal axis, and wherein the outer wall portion includes a heated air inlet concentric with the longitudinal axis, and wherein the outer wall portion further includes a trough portion disposed vertically below the heated air inlet.

8. The convection oven of claim 1, wherein the removable lid includes a wall portion generally concentric about a longitudinal axis, with a center region being disposed at a first vertical height, and a peripheral region around the central region being disposed at a greater vertical height, and wherein an inside surface of the removable lid generally is curved from the center portion to the peripheral edge.

9. The convection oven of claim 8, wherein the outer wall portion is generally symmetrical about a central longitudinal axis, and wherein the outer wall portion includes a heated air inlet concentric with the longitudinal axis, and wherein the outer wall portion further includes a trough portion disposed vertically below the heated air inlet.

10. The convection oven of claim 1, wherein the outer wall portion of the upper housing portion is not separable from the lower housing portion, and wherein the lower housing portion includes a separate base portion closing off access to the motor, the fan, and the heating element.

11. A non-recirculating convection oven comprising:

(a) an upper housing portion defining a food heating chamber, the upper housing portion including:
  (1) an outer wall portion;
  (2) a removable lid, engageable with the outer wall portion to form the food heating chamber;
  (3) at least one exhaust air outlet to an exterior of the upper housing portion;
  (4) a food supporting tray in the food heating chamber, the tray including a solid food supporting portion, an aperture through a center portion, and an upwardly extending lip around the center portion of the tray;

(b) a lower housing portion below the upper housing portion including:
  (1) an intake air inlet for intake air;
  (2) a motor;
  (3) a fan driven by the motor for moving the intake air from the air intake inlet to a heating element;
  (4) a heating element, the motor, the fan, and the heating element housed within the lower housing portion;
  (5) a heated air outlet in air flow communication with the food heating chamber; wherein the intake air enters the lower housing portion at the intake air inlet, and the intake air is then heated by the heating element, wherein the heated air passes through the heated air outlet of the lower housing portion into the food heating chamber, wherein the motor, the fan, and the heating element are capable of delivering the heated air so that in the food heating chamber the heated air is at a temperature of at least 250° F., wherein the heated air exits the food heating chamber at the at least one exhaust air outlet, wherein none of the heated air is recirculated within the oven to the fan.

12. The convection oven of claim 11, further comprising an air passage between the outer wall portion of the upper housing portion and an outer periphery of the tray.

13. The convection oven of claim 11, wherein the at least one exhaust air outlet is positioned between the removable lid and the outer wall portion of the upper housing portion.

14. The convection oven of claim 11, wherein the lower housing portion includes a lip formed around the heated air outlet, wherein the upper housing portion is separable from the lower housing portion, and wherein the upper housing portion includes a heated air inlet opening sized for receipt of the lip of the lower housing portion.

15. The convection oven of claim 14, wherein the lower housing portion includes an upper section defining a convex shape, and wherein the upper housing portion includes a lower section defining a concave shape, the upper and lower sections of the lower and upper housing portions matable when the heated air inlet receives the lip of the lower housing portion.

16. The convection oven of claim 11, wherein the outer wall portion is generally symmetrical about a central longitudinal axis, and wherein the outer wall portion includes a heated air inlet concentric with the longitudinal axis, and wherein the outer wall portion further includes a trough portion disposed vertically below the heated air inlet.

17. The convection oven of claim 11, wherein the removable lid includes a wall portion generally concentric about a longitudinal axis, with a center region being disposed at a first vertical height, and a peripheral region around the central region being disposed at a greater vertical height, and wherein an inside surface of the removable lid generally is curved from the center portion to the peripheral edge.

18. The convection oven of claim 11, wherein the outer wall portion of the upper housing portion is not separable from the lower housing portion, and wherein the lower housing portion includes a separate base portion closing off access to the motor, the fan, and the heating element.

19. A non-recirculating convection oven comprising:

(a) an upper housing portion defining a food heating chamber, the upper housing portion including:
  (1) an outer wall portion;
  (2) a removable lid, engageable with the outer wall portion to form the food heating chamber;
  (3) at least one exhaust air outlet to an exterior of the upper housing portion;
  (4) a plurality of stacked food supporting trays in the food heating chamber, the trays including a solid food supporting portion, at least one of the trays including an aperture through a center portion of the tray, the food supporting portion of the tray with the aperture surrounding the center portion;

(b) a lower housing portion below the upper housing portion including:

(1) an intake air inlet for intake air;
(2) a motor;
(3) a fan driven by the motor for moving the intake air from the air intake inlet to a heating element;
(4) a heating element, the motor, the fan, and the heating element housed within the lower housing portion;
(5) a heated air outlet in air flow communication with the food heating chamber; wherein at least a portion of the heated air is directed below the food supporting portion of the lowermost tray, and wherein the heated air exits the food heating chamber at the at least one exhaust air outlet, whereby the heated air is not recirculated within the oven to the fan.

20. A non-recirculating convection oven comprising:

(a) an upper housing portion defining a food heating chamber, the upper housing portion including:
(1) an outer wall portion;
(2) a removable lid, engageable with the outer wall portion to form the food heating chamber;
(3) at least one exhaust air outlet to an exterior of the upper housing portion positioned between the outer wall portion and the removable lid;
(4) a food supporting tray in the food heating chamber, the tray including a solid food supporting portion, the tray including a central axis and a circular outer periphery;
(5) an air passage between the outer wall portion of the upper housing portion and the outer periphery of the tray;

(b) a lower housing portion below the upper housing portion including:
(1) an intake air inlet for intake air;
(2) a motor;
(3) a fan driven by the motor for moving the intake air from the air intake inlet to a heating element;
(4) a heating element, the motor, the fan, and the heating element housed within the lower housing portion;
(5) a heated air outlet in air flow communication with the food heating chamber and concentric with the central axis of the tray; wherein at least a first portion of the heated air is directed below the food supporting portion of the tray, and wherein the first portion of the air passes through the air passage between the outer wall portion of the upper housing portion and the outer periphery of the tray before the heated air exits the food heating chamber at the at least one exhaust air outlet, whereby the heated air is not recirculated within the oven to the fan.

21. A non-recirculating convection oven comprising:

(a) an upper housing portion defining a food heating chamber, the upper housing portion including:
(1) an outer wall portion;
(2) a removable lid, engageable with the outer wall portion to form the food heating chamber;
(3) at least one exhaust air outlet to an exterior of the upper housing portion;
(4) a food supporting tray in the food heating chamber, the tray including a solid food supporting portion, the tray including a central axis and a circular outer periphery;
(5) an air passage between the outer wall portion of the upper housing portion and the outer periphery of the tray;

(b) a lower housing portion below the upper housing portion including:
(1) an intake air inlet for intake air;
(2) a motor;
(3) a fan driven by the motor for moving the intake air from the air intake inlet to a heating element;
(4) a heating element, the motor, the fan, and the heating element housed within the lower housing portion;
(5) a heated air outlet in air flow communication with the food heating chamber and concentric with the central axis of the tray; wherein the lower housing portion includes a lip formed around the heated air outlet, wherein the upper housing portion is separable from the lower housing portion, and wherein the upper housing portion includes a heated air inlet opening sized for receipt of the lip of the lower housing portion;
(6) wherein the motor, the fan, and the heating element are capable of delivering the heated air so that in the food heating chamber the heated air is at a temperature of at least 250° F., wherein at least a first portion of the heated air is directed below the food supporting portion of the tray, and wherein the first portion of the air passes through the air passage between the outer wall portion of the upper housing portion and the outer periphery of the tray before the heated air exits the food heating chamber at the at least one exhaust air outlet, whereby the heated air is not recirculated within the oven to the fan.

22. The convection oven of claim 21, wherein the at least one exhaust air outlet is positioned between the outer wall portion and the removable lid.

23. The convection oven of claim 22, wherein the tray is a single tray in the food heating chamber, the tray including an aperture through a center portion of the tray, wherein a second portion of the heated air is directed through the aperture of the tray to an area above the food supporting portion of the tray, wherein the first and second portions of the heated air exit the food heating chamber at the at least one exhaust air outlet.

24. The convection oven of claim 21, wherein the at least one exhaust air outlet is positioned in the removable lid.

25. A convection oven comprising:

(a) an upper housing portion defining a food heating chamber, the upper housing portion including:
(1) an outer wall portion;
(2) a removable lid, engageable with the outer wall portion to form the food heating chamber;
(3) at least one exhaust air outlet to an exterior of the upper housing portion;
(4) a food supporting tray in the food heating chamber, the tray including a solid food supporting portion, the tray including a central axis and a circular outer periphery;
(5) an air passage between the outer wall portion of the upper housing portion and the outer periphery of the tray;

(b) a lower housing portion below the upper housing portion including:
(1) an intake air inlet for intake air;
(2) a motor;
(3) a fan driven by the motor for moving the intake air from the air intake inlet to a heating element;
(4) a heating element, the motor, the fan, and the heating element housed within the lower housing portion;
(5) a heated air outlet in air flow communication with the food heating chamber and concentric with the central axis of the tray; wherein the lower housing portion includes a lip formed around the heated air outlet, wherein the upper housing portion is separable from the lower housing portion, and wherein the upper housing portion includes a heated air inlet opening sized for receipt of the lip of the lower housing portion;

(6) wherein the motor, the fan, and the heating element are capable of delivering the heated air so that in the food heating chamber the heated air is at a temperature of at least 250° F., wherein at least a first portion of the heated air is directed below the food supporting portion of the tray, and wherein the first portion of the air passes through the air passage between the outer wall portion of the upper housing portion and the outer periphery of the tray before at least some of the heated air exits the food heating chamber at the at least one exhaust air outlet.

26. The convection oven of claim 25, wherein the at least one exhaust air outlet is positioned between the outer wall portion and the removable lid.

27. The convection oven of claim 26, wherein the tray is a single tray in the food heating chamber, the tray including an aperture through a center portion of the tray, wherein a second portion of the heated air is directed through the aperture of the tray to an area above the food supporting portion of the tray, wherein the first and second portions of the heated air exit the food heating chamber at the at least one exhaust air outlet.

28. The convection oven of claim 25, wherein the at least one exhaust air outlet is positioned in the removable lid.

29. A non-recirculating convection oven comprising:

(a) an upper housing portion defining a food heating chamber, the upper housing portion including:
  (1) an outer wall portion;
  (2) a removable lid, engageable with the outer wall portion to form the food heating chamber;
  (3) at least one exhaust air outlet to an exterior of the upper housing portion positioned between the removable lid and the outer wall portion of the upper housing portion;
  (4) a food supporting tray in the food heating chamber, the tray including a solid food supporting portion;

(b) a lower housing portion below the upper housing portion including:
  (1) an intake air inlet for intake air;
  (2) a motor;
  (3) a fan driven by the motor for moving the intake air from the air intake inlet to a heating element;
  (4) a heating element, the motor, the fan, and the heating element housed within the lower housing portion;
  (5) a heated air outlet in air flow communication with the food heating chamber; wherein the intake air enters the lower housing portion at the intake air inlet, and the intake air is then heated by the heating element, wherein the heated air passes through the heated air outlet of the lower housing portion into the food heating chamber, wherein the motor, the fan, and the heating element are capable of delivering the heated air so that in the food heating chamber the heated air is at a temperature of at least 250° F., wherein the heated air exits the food heating chamber at the at least one exhaust air outlet, wherein none of the heated air is recirculated within the oven to the fan.

30. A non-recirculating convection oven comprising:

(a) an upper housing portion defining a food heating chamber, the upper housing portion including:
  (1) an outer wall portion;
  (2) a removable lid, engageable with the outer wall portion to form the food heating chamber;
  (3) at least one exhaust air outlet to an exterior of the upper housing portion;
  (4) a food supporting tray in the food heating chamber, the tray including a solid food supporting portion;

(b) a lower housing portion below the upper housing portion including:
  (1) an intake air inlet for intake air;
  (2) a motor;
  (3) a fan driven by the motor for moving the intake air from the air intake inlet to a heating element;
  (4) a heating element, the motor, the fan, and the heating element housed within the lower housing portion;
  (5) a heated air outlet in air flow communication with the food heating chamber; wherein the intake air enters the lower housing portion at the intake air inlet, and the intake air is then heated by the heating element, wherein the heated air passes through the heated air outlet of the lower housing portion into the food heating chamber, wherein the motor, the fan, and the heating element are capable of delivering the heated air so that in the food heating chamber the heated air is at a temperature of at least 250° F., wherein the heated air exits the food heating chamber at the at least one exhaust air outlet, wherein none of the heated air is recirculated within the oven to the fan;
  (6) a lip formed around the heated air outlet, wherein the upper housing portion is separable from the lower housing portion, and wherein the upper housing portion includes a heated air inlet opening sized for receipt of the lip of the lower housing portion.

31. The convection oven of claim 30, wherein the lower housing portion includes an upper section defining a convex shape, and wherein the upper housing portion includes a lower section defining a concave shape, the upper and lower sections of the lower and upper housing portions matable when the heated air inlet receives the lip of the lower housing portion.

32. A non-recirculating convection oven comprising:

(a) an upper housing portion defining a food heating chamber, the upper housing portion including:
  (1) an outer wall portion;
  (2) a removable lid, engageable with the outer wall portion to form the food heating chamber;
  (3) at least one exhaust air outlet to an exterior of the upper housing portion;
  (4) a food supporting tray in the food heating chamber, the tray including a solid food supporting portion;
  (5) wherein the outer wall portion is generally symmetrical about a central longitudinal axis, and wherein the outer wall portion includes a heated air inlet concentric with the longitudinal axis, and wherein the outer wall portion further includes a trough portion disposed vertically below the heated air inlet;

(b) a lower housing portion below the upper housing portion including:
  (1) an intake air inlet for intake air;
  (2) a motor;
  (3) a fan driven by the motor for moving the intake air from the air intake inlet to a heating element;

(4) a heating element, the motor, the fan, and the heating element housed within the lower housing portion;

(5) a heated air outlet in air flow communication with the heated air inlet; wherein the intake air enters the lower housing portion at the intake air inlet, and the intake air is then heated by the heating element, wherein the heated air passes through the heated air outlet of the lower housing portion, through the heated air inlet of the upper housing portion, and into the food heating chamber, wherein the motor, the fan, and the heating element are capable of delivering the heated air so that in the food heating chamber the heated air is at a temperature of at least 250° F., wherein the heated air exits the food heating chamber at the at least one exhaust air outlet, wherein none of the heated air is recirculated within the oven to the fan.

33. A non-recirculating convection oven comprising:

(a) an upper housing portion defining a food heating chamber, the upper housing portion including:

(1) an outer wall portion;

(2) a removable lid, engageable with the outer wall portion to form the food heating chamber, wherein the removable lid includes a wall portion generally concentric about a longitudinal axis, with a center region being disposed on a first vertical height, and a peripheral region around the central region being disposed at a greater vertical height, and wherein an inside surface of the removable lid generally is curved from the center portion to the peripheral edge;

(3) at least one exhaust air outlet to an exterior of the upper housing portion;

(4) a food supporting tray in the food heating chamber, the tray including a solid food supporting portion;

(b) a lower housing portion below the upper housing portion including:

(1) an intake air inlet for intake air;

(2) a motor;

(3) a fan driven by the motor for moving the intake air from the air intake inlet to a heating element;

(4) a heating element, the motor, the fan, and the heating element housed within the lower housing portion;

(5) a heated air outlet in air flow communication with the food heating chamber; wherein the intake air enters the lower housing portion at the intake air inlet, and the intake air is then heated by the heating element, wherein the heated air passes through the heated air outlet of the lower housing portion into the food heating chamber, wherein the motor, the fan, and the heating element are capable of delivering the heated air so that in the food heating chamber the heated air is at a temperature of at least 250° F., wherein the heated air exits the food heating chamber at the at least one exhaust air outlet, wherein none of the heated air is recirculated within the oven to the fan.

* * * * *